US006644186B2

(12) United States Patent
Herrou et al.

(10) Patent No.: US 6,644,186 B2
(45) Date of Patent: Nov. 11, 2003

(54) COPY-GUIDING DEVICE FOR FLAT COPIES IN FOLDERS

(75) Inventors: Eric Herrou, Thiverny (FR); Alain Maresse, Neufvy sur Aronde (FR); Thierra Melon, Breuil le Vert (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/968,246

(22) Filed: Oct. 1, 2001

(65) Prior Publication Data

US 2002/0059877 A1 May 23, 2002

(30) Foreign Application Priority Data

Sep. 29, 2000 (DE) ..... 100 48 386

(51) Int. Cl.[7] ..... B41F 13/54

(52) U.S. Cl. ..... 101/227; 101/480; 400/621; 400/635; 271/264

(58) Field of Search ..... 101/219, 226, 101/227, 480; 400/621, 635, 642; 271/69, 264

(56) References Cited

U.S. PATENT DOCUMENTS 1,337,778 A * 4/1920 Leonard ..... 83/165
4,684,276 A * 8/1987 Frei et al. ..... 400/630
5,036,737 A * 8/1991 Glaser ..... 83/100
5,273,515 A * 12/1993 Fenske ..... 493/416
5,820,122 A 10/1998 Schneider
5,839,365 A 11/1998 Calbrix et al.
6,176,180 B1 * 1/2001 Taylor et al. ..... 101/148

FOREIGN PATENT DOCUMENTS

| | | |
|---|---|---|
| DE | 3917845 C2 | 11/1992 |
| FR | 2 751 630 A1 | 1/1998 |
| JP | 11 005 657 | 1/1999 |

* cited by examiner

*Primary Examiner*—Daniel J. Colilla
*Assistant Examiner*—Jill E Culler
(74) *Attorney, Agent, or Firm*—Lawrence A. Greenberg; Werner H. Stemer; Gregory L. Mayback

(57) ABSTRACT

A device for guiding copies severed from a material web in a folder by a cutting-cylinder pair includes revolving transport tapes for picking up the copies after they have passed through a copy guide arranged in an outlet wedge of the cutting-cylinder pair, the copy guide extending at least partly over the width of the material web, and being formed of copy guide sections which are automatically adjustable, both with respect to the width of the copies to be guided and with respect to a passage cross section for the copies to be guided; a folder including the copy-guiding device; and a web-processing rotary printing machine including at least one folder with at least one device according to the invention.

16 Claims, 5 Drawing Sheets

COPY-GUIDING DEVICE FOR FLAT COPIES IN FOLDERS

BACKGROUND OF THE INVENTION

Field of the Invention

The invention relates to a copy-guiding device for flat copies in folders, the copies being severed by cutting devices in the folders from single-layer or multi-layer material webs, and folded.

The published European Patent Document EP 0 400 596 A3 is concerned with a cutting device for a folder in a rotary printing machine. The cutting device includes two cooperating cutting cylinders for a material web which runs vertically into the pair of cutting cylinders, and transport tape lines arranged downline from the cutting cylinders, as viewed in a travel direction of copies through the folder. The transport tape lines run over deflection rollers and guide the cut-off products therebetween. In order to provide a guide for an exact entry of the products between the transport tape lines, blowing or blast nozzles directed into the cutting nip between the web and the cutting cylinder are provided on both sides of the incoming web, and cutting cylinders with grooves for passage of the blown air are provided parallel to the web.

In another construction, there is provided a device for guiding signatures, in particular in the vicinity of an outlet wedge of a cutting cylinder arrangement in a folder disposed downline from a rotary printing machine, as viewed in the copy travel direction. According to this construction, one or more guide tapes extending at least approximately transversely to the transport direction of the signatures are arranged close to the transport path of the signatures and define guide surfaces limiting the transport path of the signatures.

U.S. Pat. No. 5,839,365 and French Patent 2 751 630 disclose a copy guide for a folder having a pair of cutting cylinders with a cutting nip therebetween wherein individual flat copies are severed from a continuously supplied material web. Downwardly extending transport tapes are guided over deflection rollers for the purpose of onwardly conveying the severed, individual folded copies. Assigned to the cutting cylinders of the cutting-cylinder pair is a product guiding unit which extends at least partly over the width of the material web to be processed. The open space or clearance extending from the cutting nip to the inlet nip and into transport tapes disposed downline from the cutting cylinders is bridged by the stationary product guiding unit arranged underneath the cutting-cylinder wedge.

A disadvantage of a stationary copy guide lies primarily in that the adaptability thereof to changing production parameters, such as a greater paper thickness or a greater number of streams within a material web, and also web widths to be processed flexibly, are achievable only with considerable difficulty, because the fixedly mounted copy guide has to be shifted manually. This, firstly, requires an expenditure of set-up time and, secondly, necessitates production outages or shut-downs in the rotary system. It has been shown that a permanently predefined guide, at least approximately configured as a stationary former, only inadequately takes variable production requirements into account.

SUMMARY OF THE INVENTION

In view of the inadequate remedies suggested heretofore in the prior art, and the technical problem indicated, it is an object of the invention to provide a product guide for flat copies in a folder, which is adjustable based upon the width of the material being processed and, beginning at a specific speed level, is automatically movable into an outlet wedge located downline from a cutting-cylinder pair, as viewed in a travel or conveying direction of the copies.

With the foregoing and other objects in view, there is provided, in accordance with one aspect of the invention, a device for guiding copies severed from a material web in a folder by a cutting-cylinder pair, comprising revolving transport tapes for picking up the copies after they have passed through a copy guide arranged in an outlet wedge of the cutting-cylinder pair, the copy guide extending at least partly over the width of the material web, and being formed of copy guide sections which are automatically adjustable, both with respect to the width of the copies to be guided and with respect to a passage cross section for the copies to be guided.

In accordance with another feature of the invention, the copy guide sections of the copy guide have, at an end thereof facing towards an outlet wedge of the cutting-cylinder pair, a greater cross section than at an exit from the copy guide sections, which is located opposite an inlet nip of the transport tapes.

In accordance with a further feature of the invention, the copy guide sections are disposed in the shape of a funnel extending in a copy-conveying direction.

In accordance with an added feature of the invention, the copy guide sections are disposed so as to be movable on the guide elements.

In accordance with an additional feature of the invention, the device includes a shaft mounting, and spring elements supported on the shaft mounting, the guide elements being prestressed on guide rods by the spring elements.

In accordance with yet another feature of the invention, inner surfaces formed on the copy guide sections are movable between a first nip width and a second nip width.

In accordance with yet a further feature of the invention, the copy guide sections are formed with inner surfaces, and include a friction-reducing coating provided on the inner surfaces, respectively.

In accordance with yet an added feature of the invention, the copy guide sections are formed with rounded inlet edges on a side thereof disposed opposite the outlet wedge of the cutting-cylinder pair.

In accordance with yet an additional feature of the invention, the copy guide sections are movable between a first position and a second position in the outlet wedge, perpendicularly to a conveying direction of the copies.

In accordance with still another feature of the invention, the device of the invention includes toothed sections and formlocking drives interacting therewith for moving the copy guide sections perpendicularly to a conveying direction of the copies. In this regard, it is noted that a formlocking connection is one which connects two elements together due to the shape of the elements themselves, as opposed to a force-locking connection, which locks the elements together by force external to the elements.

In accordance with still a further feature of the invention, the device of the invention includes a mounting for accommodating the drives, and an actuator for setting the mounting so that the copy guide sections are located in a rest position outside a conveying plane of the copies.

In accordance with still an added feature of the invention, the copy guide sections are automatically transferrable from the first position thereof into the second position thereof at production speeds above 35,000 copies per hour.

In accordance with still an additional feature of the invention, the first position is attained at production speeds of <35,000 copies per hour.

In accordance with another aspect of the invention, there is provided a folder having a device for guiding copies severed from a material web by a cutting-cylinder pair, comprising revolving transport tapes for picking up the copies after they have passed through a copy guide arranged in an outlet wedge of the cutting-cylinder pair, the copy guide extending at least partly over the width of the material web, and being formed of copy guide sections which are automatically adjustable, both with respect to the width of the copies to be guided and with respect to a passage cross section for the copies to be guided.

In accordance with a further aspect of the invention, there is provided a folder for pinless processing of copies, having a device for guiding copies severed from a material web by a cutting-cylinder pair, comprising revolving transport tapes for picking up the copies after they have passed through a copy guide arranged in an outlet wedge of the cutting-cylinder pair, the copy guide extending at least partly over the width of the material web, and being formed of copy guide sections which are automatically adjustable, both with respect to the width of the copies to be guided and with respect to a passage cross section for the copies to be guided.

In accordance with a concomitant aspect of the invention, there is provided a web-processing rotary printing machine having at least one folder with at least one device for guiding copies severed from a material web by a cutting-cylinder pair, comprising revolving transport tapes for picking up the copies after they have passed through a copy guide arranged in an outlet wedge of the cutting-cylinder pair, the copy guide extending at least partly over the width of the material web, and being formed of copy guide sections which are automatically adjustable, both with respect to the width of the copies to be guided and with respect to a passage cross section for the copies to be guided.

The advantages which can be achieved by the construction according to the invention are primarily in that assurance is now offered that, at production speeds below a specific predefinable speed threshold, the copy guide does not impair the passage of copies through the outlet wedge of a cutting cylinder arrangement, while at the production speed exceeding the predefinable speed threshold, assurance is offered, in the pinless operating folder, that the copy guide sections are automatically set into position based upon the web width. Furthermore, the relative mobility of the copy guide sections perpendicular to the conveying plane of the copies ensures that the gap or nip geometry is adapted to the production conditions, i.e., the number of copy thicknesses, at least approximately determined by the number of web streams which are contained in a material web.

The embodiment proposed according to the invention advantageously permits the copy transfer through an outlet wedge disposed downline from a cutting-cylinder pair to be produced in acceleration tapes, such as are provided in pinless folders. According to an advantageous refinement of the idea upon which the invention is based, the copy guide sections of the movable copy guide are provided at the end facing the outlet wedge of the cutting-cylinder arrangement with a greater cross-sectional area, as compared with that at the exit at the end opposite to the inlet nip of the transport tapes. As a result, it is possible to take into account that the circumstance wherein the copies that have left the ideal, strictly vertical conveying plane pass through the copy guide sections and, therefore, extend or run reliably into the inlet nip formed between the acceleration tapes.

The copy guide sections can particularly advantageously be set against one another in the shape of a funnel, with reference to the copy conveying plane.

According to an extremely advantageous development of the concept upon which the invention is based, the copy guide sections are fitted so that they are movable on guide elements. The guide elements can be formed on one side as guide rods, whereon spring elements are accommodated, which are supported with one end on the copy guide section and, at the opposite end thereof, rest on a shaft bearing wherein the guide element is held.

The inner surfaces which are formed on the copy guide sections and which, respectively, lie opposite the front and rear of the copy severed from the material web in the cutting cylinder nip can advantageously be provided with a coating that reduces the friction. Thus, in the event of contact between the freshly printed copy and the inner surfaces of the copy guide sections, assurance is provided that no deposition of ink occurs thereat, and that the products do not deposit ink on the inner surfaces and pick it up from the latter in the event of contact.

In order to take into better account the inlet characteristics of the copies severed from a single-layer or multi-layer material web, the copy guide sections can be formed with rounded inlet edges in the vicinity of the entry or inlet nip.

In order to adapt the position of the copy guide sections in the outlet wedge of a cutting-cylinder pair perpendicularly to the conveying direction of the copies, the copy guide sections can be moved between a first position and a second position. The first position advantageously corresponds to a minimum processible web width, while the second setting position of the copy guide sections corresponds to a maximum processible material web width. This is similarly true of the copies severed from the various web widths and the intermediate format graduations thereof, and to be folded in the folder. The inward movement of the copy guide sections in the outlet wedge disposed downline from a cutting-cylinder pair is preferably performed by toothed sections and formlocking drives cooperating or interacting with the latter, such as electric drives; in addition, spindle drives may also readily be used.

Due to the drives, whether they are electromotive, pneumatic or hydraulic, the position of the copy guide sections can be adjusted between a first and a second position; furthermore, provision can be made to move, as a whole, the drive of the copy guide sections, which moves the latter into the first and into the second position, in such a way that, below a specific predefinable speed threshold, the copy guide sections may moreover be put into a rest position outside the web running plane and, therefore, the copy running plane, underneath the cutting nip of the cutting cylinder arrangement. In this rest position, which can be selected for example at speeds below 35,000 copies per hour, the copy guide sections which can be moved perpendicularly to the web running or conveying plane are put into an inactive position and have no effect upon the copy transport taking place in the folder in the outlet wedge of a cutting-cylinder pair.

The improvement proposed in accordance with the invention of a copy-guiding device that can be adjusted automatically based upon the material web width to be processed, and also the adaptability thereof in relation to the free passage area depending upon the width or thickness of the severed folded copy, may be employed particularly advantageously in combination with the automatic triggering of the adjustment when the speed in folders exceeds or falls below a production speed threshold. The construction proposed by the invention can be used, in particular, in pinless folders, wherein the folded copies severed from the material web in the cutting nip run into acceleration tapes disposed downline from the outlet wedge. The folders equipped with a copy-guiding device configured in such a way are preferably in web-processing rotary printing machines, whether they are used for newspaper printing or for jobbing web-fed printing.

Other features which are considered as characteristic for the invention are set forth in the appended claims.

Although the invention is illustrated and described herein as embodied in a copy-guiding device for flat copies in folders, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
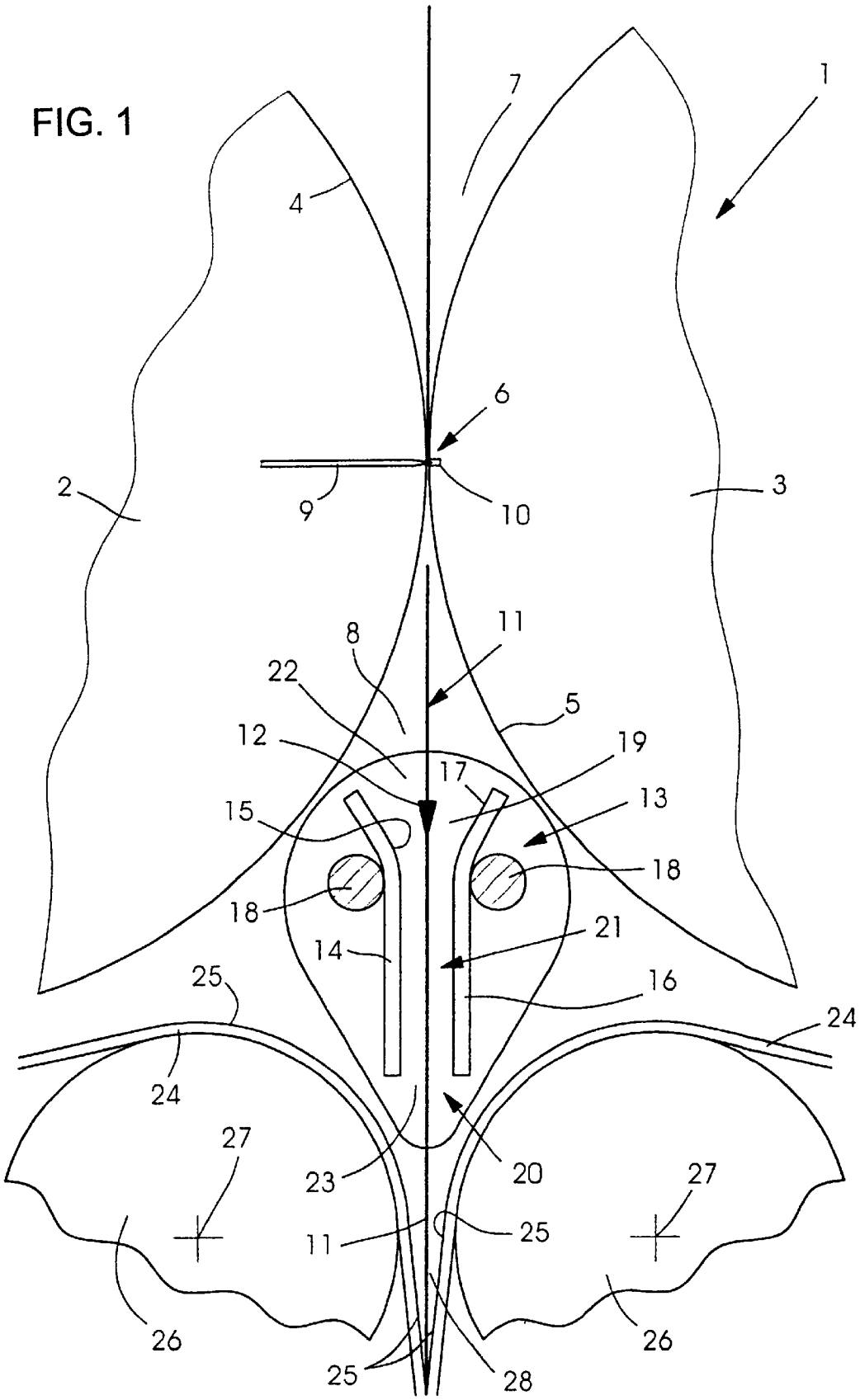
FIG. 1 is a diagrammatic side elevational view of a cutting-cylinder outlet wedge disposed parallel to guide elements in displaceable copy guide sections.

Referring now to the drawings and, first, particularly to FIG. 1 thereof, there is revealed therein in detail, in a side elevational view, an outlet wedge defined by a cutting cylinder pair, together with copy guides which are movable parallel to guide sections.

The cylinder pair 1 shown diagrammatically in FIG. 1 includes a knife cylinder 2 which, in a cutting nip or gap 6, cooperates with an opposed grooved cylinder 3. The grooved cylinder 3 has an outer surface 5, while the knife cylinder 2 has an outer surface 4. In the condition shown in FIG. 1, the cutting knife 9 mounted on the knife cylinder 2 dips into an opposed grooved bar 10 of the grooved cylinder 3 and severs a copy 11 from the material web that has run into the inlet wedge 7.

The copy 11 severed from the material web passes through the outlet wedge 8 of the cutting-cylinder pair 1 and a copy guide 13 movable relatively to one another and, after the copy 11 passes through the copy guide 13, the copy 11 is introduced into an inlet nip of acceleration tapes 24 cooperating with one another.

The copies 11 severed in the cutting nip 6 by the interaction of the cutting knife cylinder 2 and the grooved bar 10 of the grooved cylinder 3, depending upon the production speed, run into the relatively movable copy guide 13, the position of which relative to the incoming material web and, therefore, to the folded copies 11 is adjustable. The relatively movable copy guide 13 includes two copy guide sections 14 and 16, respectively, but may include one or more. The inner surfaces of the copy guide sections 14 and 16, facing the front and back, respectively, of the incoming copy 11, are identified by reference numerals 15 and 17, respectively. The inner surfaces 15 and 17 of the copy guide sections 14 and 16 can advantageously be provided with friction-reducing coatings in order to prevent marking and ink deposition and also incipient retransfer of ink to the copy surfaces 11.

In the entry region 19 into the relatively movable copy guide 13, the latter is formed with an inlet width 22 which is dimensioned so as to be greater than the outlet width 23 at the exit 20 from the relatively movable copy guide 13. In the region between the inlet width 22 and the outlet width 23, the relatively movable copy guide 13 according to FIG. 1 is constructed at least approximately with a constant gap width 21.

After passing the exit 20 from the movable copy guide 13, the individual copies severed from the material web, conveyed in the copy-conveying direction represented by the arrowhead 12, run into an inlet nip 28 formed by the acceleration tapes 24 revolving around deflection rollers 26. The acceleration tapes 24, which run at high speed around the deflection rollers 26, and are rotatable about axes of rotation 27, are provided on the upper sides thereof with contact surfaces 25 in order to grip the copies 11, accelerate them and lead them to a non-illustrated transfer cylinder located in the further course of the tape trains 24.

Figure 2:
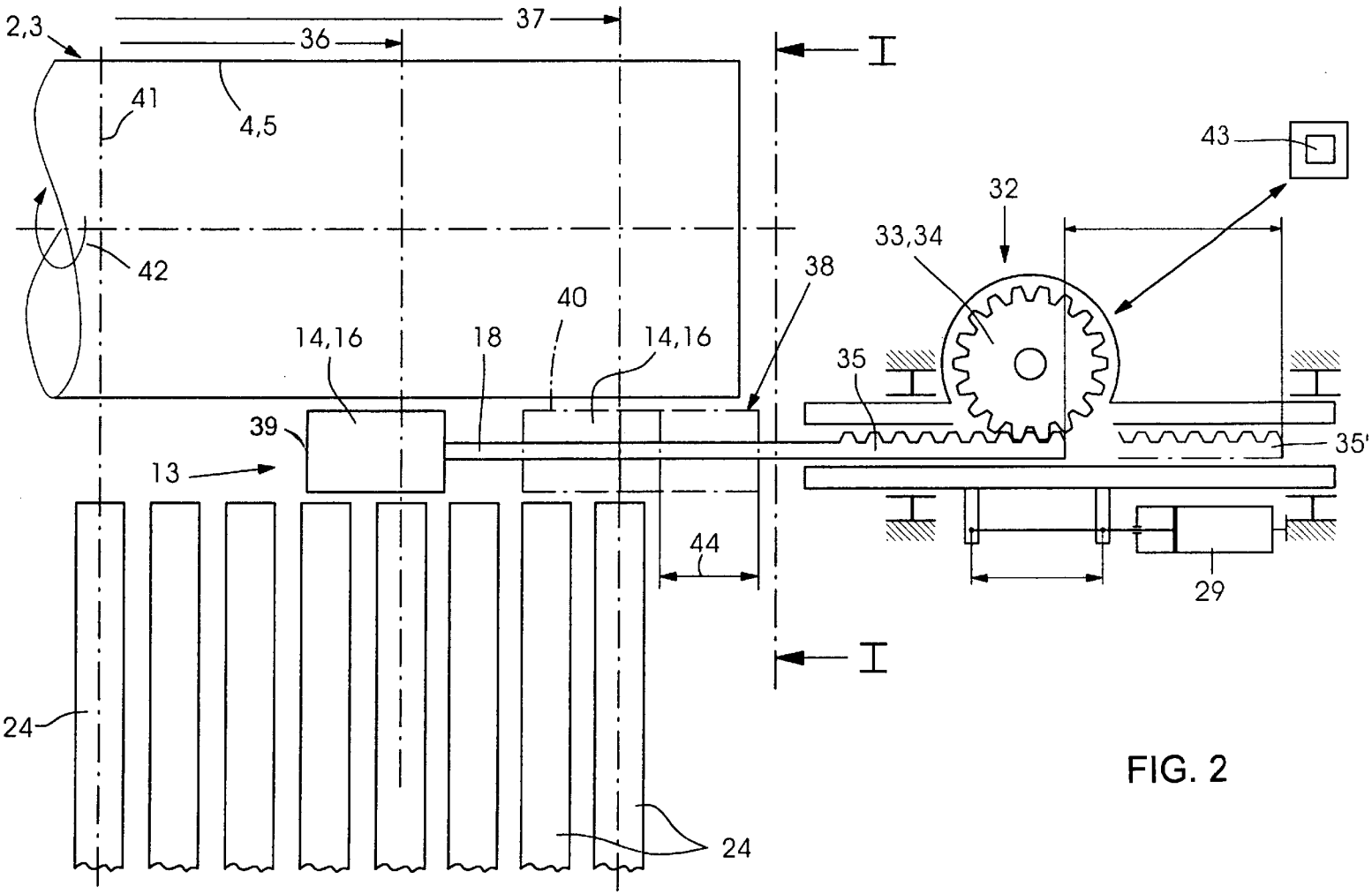
FIG. 2 is a diagrammatic side elevational view of a copy guide adjustable into two operating positions relative to a cutting cylinder, and a drive provided for effecting the adjustment.

FIG. 2 reveals in greater detail the copy guide 13, which is adjustable into two operating positions in relation to the cutting knife cylinder 2, and also an actuating drive for effecting the adjustment.

In FIG. 2, the cutting cylinder arrangement 1 is shown in a side elevational view. The cutting cylinder arrangement 1 at least includes the knife cylinder 2 and the grooved cylinder 3, respectively, located behind one another in this view; the limit of the outer surface 4 or 5 of one of the two cylinders mentioned is shown in FIG. 2. The cylinders of the cutting-cylinder pair 1, respectively, rotate about the respective axes of thereof in a direction of rotation rotation represented by the curved arrow 42, the center of the machine being identified by the reference numeral 41.

Illustrated underneath the outer surfaces 4, 5 of the cutting knife cylinder arrangement 2, 3 are the acceleration tapes 24, which may include a large number of individual tapes arranged beside one another and distributed over the web width. In addition to the arrangement of the acceleration tapes 24 shown purely diagrammatically in FIG. 2, other arrangements of the acceleration tapes 24 can also be imagined. In the outlet wedge 8 above the inlet to the acceleration tapes 24, the copy guide sections 14, 16 are shown, configured according to the invention and adjustable in a multiplicity of directions in relation to the copy conveying path. In a first position 39 of the copy guide sections 14 and 16 which, in FIG. 2, are reproduced lying behind one another, the copy guide sections 14 and 16 have been placed in a position which corresponds to a minimum processible web width 36. By comparison, a second position 40 of the copy guide sections 14 and 16, shown in phantom, coincides with the lateral position 37 of the maximum processible web width.

Finally, in a rest position 38 of the copy guide sections 14 and 16, which is assumed thereby when the production speed in the folder, wherein a device proposed in accordance with the invention is accommodated in order to improve the product transfer, lies below a specific predefinable threshold, for example, 35,000 copies per hour. If the speed exceeds the preselectable threshold, such as 35,000 copies per hour, only slightly, the drive 32 is then driven automatically via a control element 43, as a result of which, depending upon the web width programmed in the context of the presetting operation, the copy guide sections 14 and 16 are moved parallel to one another into the corresponding position thereof, i.e., into the first position 39 or into the second position 40, respectively, corresponding with the processible web widths 36 and 37. Assurance is, therefore, provided that the operating personnel of the folder configured in accordance with the invention do not have to perform any actions at the manual level, because the copy guide sections 14 and 16 are moved perpendicularly to the conveying direction 12 of the copies 11 automatically after a predefinable speed threshold has been exceeded.

FIG. 2 shows the copy guide sections 14, 16 of the movable copy guide 13 carried by guide elements 18. At the ends of the latter facing towards a drive 32, the guide elements 18 can be provided, for example, with toothed passages 35. In FIG. 2, a position 35' of the toothed section 35 represents an at-rest position of the copy guide sections 14, 16. This position 35' corresponds to the horizontal displacement travel of the copy guide sections 14, 16 which can be achieved by the drive 32 perpendicularly to the travel direction 12 of the folded copies 11 severed from the material web.

The entire mounting of the drive 32 of the guide elements 18 is, in turn, movable by an actuator, for example, a pneumatic or hydraulic cylinder, so that the copy guide sections 14 and 16 are placed completely outside the acceleration tapes 24. In this region 44, the copy guide sections 14 and 16, respectively, are completely inactive, so that they can exert no influence on the passage of folded copies 11 through the outlet wedge 8 downline from the cutting-cylinder pair 1. The travel path distance transferable by the drive 32 and the drive elements 33, 34 to the guide elements 18 of the copy guide sections 14, 16 preferably corresponds to the difference between the maximum processible web width 37 and the minimum processible web width 36, so that it is possible to move to all the individually graduated positions between these two extreme positions.

The drive unit 32 for the translational movement of the copy guide sections 14 and 16 can be moved into the rest position 38 by a separately operatable actuator element 29.

Figure 3:
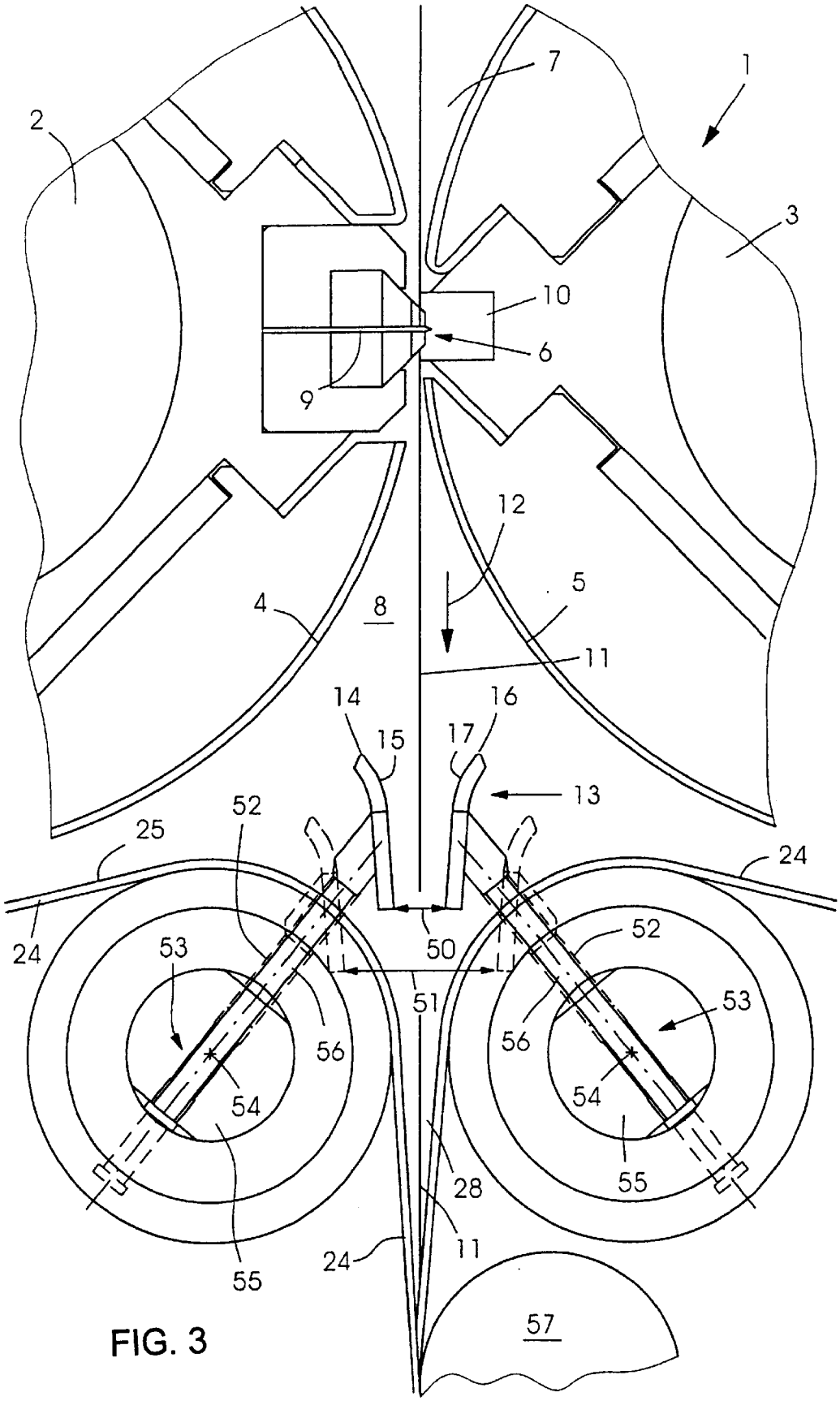
FIG. 3 is a view similar to that of FIG. 2 showing a sprung copy guide having two copy guide sections with a variable nip geometry.

FIG. 3 illustrates a movable copy guide device with a variable nip geometry constructed in accordance with the invention.

According to FIG. 3, the cutting-cylinder pair 1 shown therein includes a knife cylinder 2 and a grooved cylinder 3, analogous to the construction thereof already illustrated in FIG. 1. The knife cylinder 2 has a jacket or outer cylindrical surface 4; the grooved cylinder 3 has a jacket or outer cylindrical surface 5. Accommodated on the outer surface 5 of the grooved cylinder 3 is a grooved bar 10 into which, in a cutting nip 6, the knife 9 fitted to the circumferential surface 4 of the knife cylinder 2 dips in order to separate or sever individual copies 11 from a material web conveyed in the direction of movement represented by the arrow 12.

The severed copies 11 pass through the outlet wedge 8 of the cutting-cylinder pair 1 and enter the movable copy guide 13. The copy guide 13 preferably includes two copy guide sections 14 and 16 which are set against one another in a funnel-shaped manner and have inlet edges which can be constructed with a slightly rounded contour, in order also to accommodate copies 11 not conveyed exactly in the vertical direction 12 and to prevent the copies 11 from fluttering, at a speed above a specific production speed.

The copy guide sections 14 and 16 are provided with inner surfaces 15 and 17, respectively, which, in turn, can be provided with friction-preventing coatings in order to permit passage of the front and back of the severed copies 11, free of any markings or ink deposition, through the movable copy guide 13.

The copy guide sections 14 and 16, respectively, are fitted to spring element guides 56. The compression spring elements 52 are disposed coaxially with the spring element guides 56 and are supported at one end thereof on a shaft bearing 55, and bear at the other end thereof on the outer surfaces of the copy guide sections 14 and 16, and prestress the latter. A first gap width 50 between the copy guide sections 14 and 16 is thereby attained, whereas a far greater gap width 51 between the copy guide sections 14 and 16 shown in broken lines is sought after when the copies are thicker, for example, in the case of multi-layer folded copies 11. The gap widths 50 and 51, respectively, match the production requirements accordingly; the prestressing force of the copy guide sections 14 and 16, respectively, can be preset by the spring constant and the number of turns on the spring elements 52. In addition to the spring element guides 56, the deflection rollers 27 for the acceleration tapes 24 can advantageously also be mounted on the shaft bearing 55, in a manner similar to that for the construction in FIG. 1. Arranged downline from the tapes 24 in FIG. 3 is a deflection roller 57, which is used to form the inlet wedge 28 between the acceleration tapes 24 for transporting the copies 11 to the transfer cylinder (not shown in FIG. 3).

The deflection rollers 26 have rotational axes 54. The spring element guides 56, respectively, are supported by prestressed mountings 53.

Figure 4:
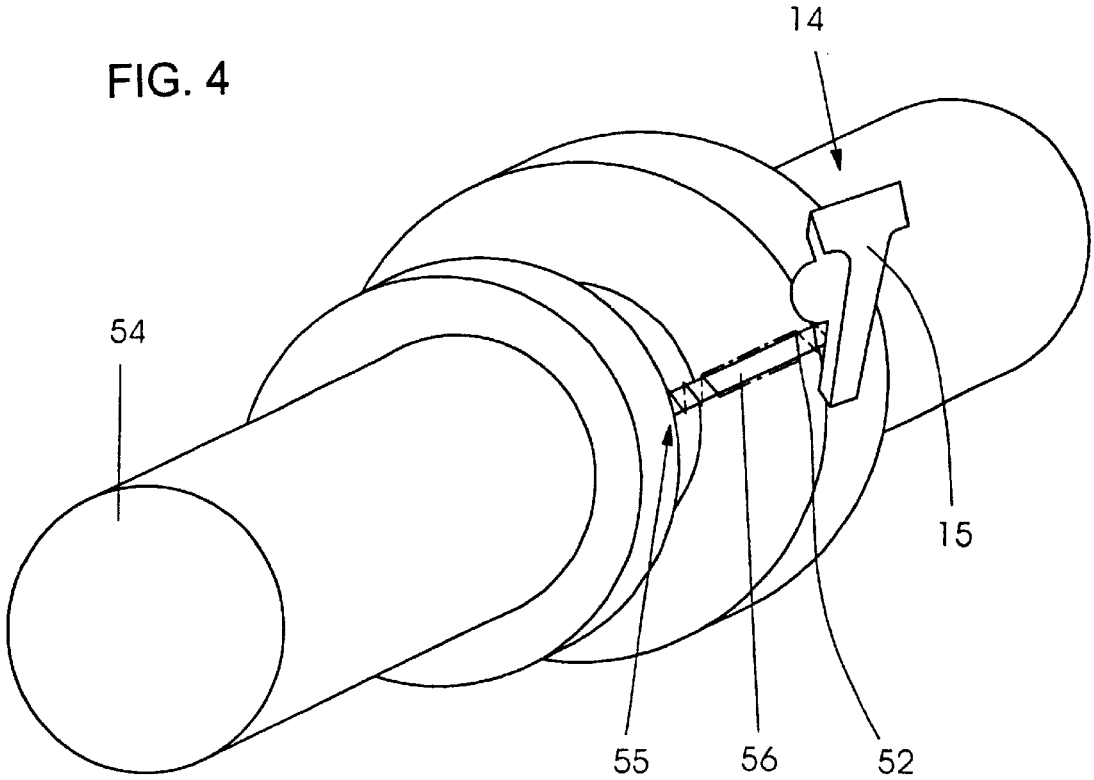
FIG. 4 is a perspective view of a spring-mounted copy-guiding section.

FIG. 4 reveals in greater detail in a perspective view, a spring-mounted copy-guiding section.

On the side facing the copy 11 (not shown in FIG. 4), the copy guide section 14 is preferably provided, on the inner side 15 thereof, with a friction-reducing coating which is not specifically identified in FIG. 4. The copy guide section 14 is prestressed by a spring element 52 and gives way or yields when the product thickness increases, so that the copy guide section 14 is forced closer to the shaft 54. In addition to the prestressed mounting 53 for the respective copy guide sections 14, deflection rollers 27 for the acceleration tapes 24 can also advantageously be provided on the shaft 54. The acceleration tapes 24 convey the printed copies passing the movable copy guide to a multiple-size transfer cylinder, i.e., a cylinder having a size which is a multiple of the conventional cylinder size in a printing unit, not shown in FIG. 4 (however, note FIG. 5), which belongs to a folder and from which they are processed further.

Figure 5:
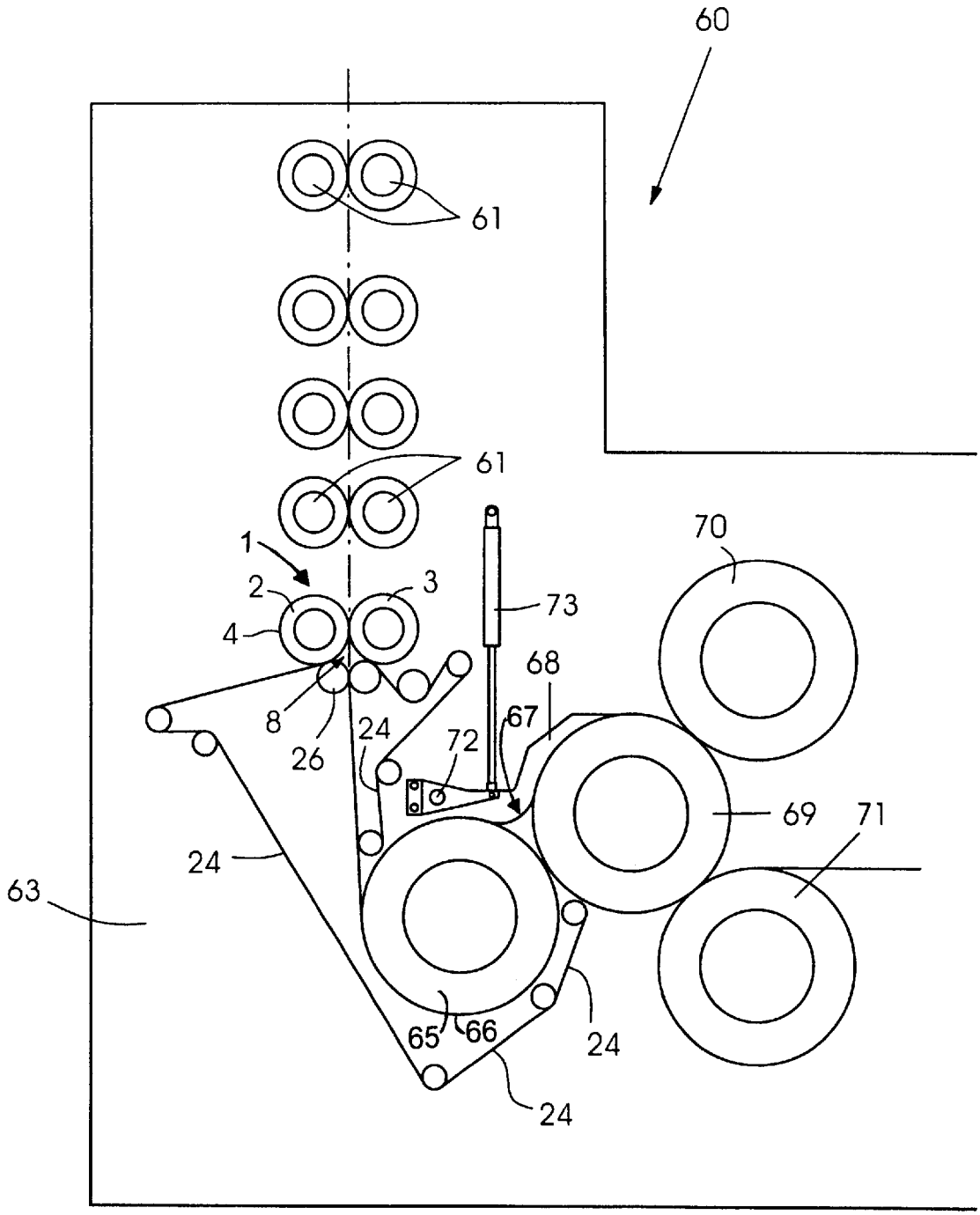
FIG. 5 is a diagrammatic side elevational view of a folder wherein copy transport is performed without pins.

FIG. 5 shows in greater detail a section through a folder wherein the copy transport is performed without pins.

Illustrated in FIG. 5, is a folder 60 having a first longitudinal folding device (not shown). Disposed underneath the first longitudinal folding device, in a vertical arrangement, is a large number of pull or draw-roller pairs 61, which define the at least approximately vertically extending web conveying path.

Disposed downline from the last draw-roller pair 61 is the cutting-cylinder pair 1 which includes the grooved cylinder 3 and the knife cylinder 2. The circumferential or jacket surfaces 4 and 5 of the cylinders 2 and 3 of the cutting-cylinder pair 1 determine the geometry of the cutting nip and also of the inlet wedge 7 and of the outlet wedge 8. Associated with the outlet wedge 8 are acceleration tapes 24, which interact with one another in a manner that the folded copies 11 severed from the material web in the cutting nip 6 of the cutting-cylinder pair 1 and entering the acceleration tapes 24 run onto the circumferential surface of a transfer cylinder 65. FIG. 5 shows that the circumference of the transfer cylinder 65 in the exemplary embodiment selected here is dimensioned to be five times as large as the cylinders of the cylinder-pairs 61 preceding it. Thus, five single copies 11 in succession or lying behind one another can be accommodated on the circumference 66 of the transfer cylinder 65.

From the circumferential surface 66 of the transfer cylinder 65, the individual folded copies 11, for example, gripped by grippers, are transferred into a transfer area 67. Here, in the transfer area 67, the individual copies 11 accommodated on the circumferential surface 66 of the transfer cylinder 65 are pushed by extending folding blades into folding jaws of a folding-jaw cylinder 69, the diameter of the latter being of somewhat smaller dimension than that of the transfer cylinder 65.

The transfer area 67 is bounded by a product guide 68, which is pivotable about an axis 72. In order to pivot the product guide 68, i.e., to set the product guide 68 away from the transfer area 67, an actuating cylinder 73 is provided, which may be a pneumatically operated cylinder or a hydraulic cylinder.

Arranged downline from the circumferential surface of the folding-jaw cylinder 69, the folding jaws of which, respectively, include a stationary and a movable part, not otherwise specifically illustrated in FIG. 5, which are an upper transfer cylinder 70 and a lower transfer cylinder 71, respectively. From the latter, the copies 11, respectively, which are picked up, run into second longitudinal folding devices (not illustrated in FIG. 5), wherein reciprocatingly oscillating folding blades, if necessary or desirable, impress a second longitudinal fold into the copies 11 to be folded, before the so-folded copies can be fed, in paddle-wheelshaped delivery devices and via transport belts, to further processing units.

In a side wall 63 of the folder 60, the shafts accommodating the folding cylinders and transfer cylinders 65, 69, 70, 71 are mounted. The side walls 63 of the folder 60, of which only one is shown in FIG. 5, rest on a foundation which is set up on the floor area in printing plant.

The movable copy guide 13, which is arranged downline of a cutting-cylinder pair 1 and at least approximately includes two copy guide sections 14 and 16, respectively, which can be set against one another, can be moved perpendicularly to the copy travel plane and can have rounded inlet edges, can be used both in folders which produce only single cross-fold (tabloid), double-parallel or delta fold, second longitudinal folding devices being usable therein only optionally. The decisive factor for improving quality is that, in folders operating without pins, copy guidance is performed directly after the leading end of the copy 11 severed in the cutting nip 6 enters the outlet wedge 8 and, with the device proposed in accordance with the invention, individual production requirements can be taken into account so that, at all production speeds and among all processible web formats, reliable entry into the nip 28 between interacting acceleration tapes 24 is assured and, consequently, correct conveyance occurs to the transfer cylinder 65 of the copies 11 which are to be folded.

We claim:

1. A device for guiding copies severed from a material web in a folder by a cutting-cylinder pair, comprising revolving transport tapes for picking up the copies after they have passe through a copy guide arranged in an outlet wedge of the cutting-cylinder pair, said copy guide extending at least partly over the width of the material web, and being formed of copy guide sections, and a drive for automatically adjusting said copy guide sections, both with respect to the width of the copies to be guided and with respect to a passage cross section for the copies to be guided.

2. The device according to claim 1, wherein said copy guide sections of said copy guide have, at an end thereof facing towards said outlet wedge of the cutting-cylinder pair, a greater cross section than at an exit from said copy guide sections, which is located opposite an inlet nip of said transport tapes.

3. The device according to claim 2, wherein said copy guide sections are disposed in the shape of a funnel extending in a copy conveying direction.

4. The device according to claim 1, including guide elements, said copy guide sections being disposed so as to be movable on said guide elements.

5. The device according to claim 4, including a shaft mounting, and spring elements supported on said shaft mounting, said guide elements being prestressed on guide rods by said spring elements.

6. The device according to claim 4, wherein inner surfaces formed on said copy guide sections are movable between a first nip width and a second nip width.

7. The device according to claim 4, wherein said copy guide sections are movable between a first position and a second position in said outlet wedge, perpendicularly to a conveying direction of the copies.

8. The device according to claim 7, wherein said copy guide sections are automatically transferrable from said first position thereof into said second position thereof at production speeds above 35,000 copies per hour.

9. The device according to claim 7, wherein said first position is attained at production speeds of <35,000 copies per hour.

10. The device according to claim 4, including toothed sections and formlocking drives interacting therewith for moving said copy guide sections perpendicularly to a conveying direction of the copies.

11. The device according to claim 10, including a mounting for accommodating said drives, and an actuator for setting said mounting so that said copy guide sections are located in a rest position outside a conveying plane of the copies.

12. The device according to claim 1, wherein said copy guide sections are formed with inner surfaces, and including a friction-reducing coating provided on said inner surfaces, respectively.

13. The device according to claim 1, wherein said copy guide sections are formed with rounded inlet edges on a side thereof disposed opposite said outlet wedge of said cutting-cylinder pair.

14. A folder having a device for guiding copies severed from a material web by a cutting-cylinder pair, comprising revolving transport tapes for picking up the copies after they have passed through a copy guide arranged in an outlet wedge of the cutting-cylinder pair, said copy guide extending at least partly over the width of the material web, and being formed of copy guide sections, and a drive for automatically adjusting said copy guide sections, both with respect to the width of the copies to be guided and with respect to a passage cross section for the copies to be guided.

15. A folder for pinless processing of copies, having a device for guiding copies severed from a material web by a cutting-cylinder pair, comprising revolving transport tapes for picking up the copies after they have passed through a copy guide arranged in an outlet wedge of the cutting-cylinder pair, said copy guide extending at least partly over the width of the material web, and being formed of copy guide sections, and a drive for automatically adjusting said copy guide sections, both with respect to the width of the copies to be guided and with respect to a passage cross section for the copies to be guided.

16. A web-processing rotary printing machine having at least one older with at least one device for guiding copies severed from a material web by a cutting-cylinder pair, comprising revolving transport tapes for picking up the copier after they have passed through a copy guide arranged in an outlet wedge of the cutting-cylinder pair, said copy guide extending at least partly over the width of the material web, and being formed of copy guide sections, and a drive for automatically adjusting said copy guide sections, both with respect to the width of the copies to be guided and with respect to a passage cross section for the copies to be guided.

* * * * *